United States Patent [19]

Iritani et al.

[11] 4,318,383

[45] Mar. 9, 1982

[54] VAPOR FUEL PURGE SYSTEM FOR AN AUTOMOTIVE VEHICLE

[75] Inventors: Hidenori Iritani; Yasumichi Tomizawa, both of Yokohama, Japan

[73] Assignee: Nissan Motor Company, Limited, Yokohama, Japan

[21] Appl. No.: 122,925

[22] Filed: Feb. 20, 1980

[30] Foreign Application Priority Data

Mar. 8, 1979 [JP] Japan ..... 54-26199

[51] Int. Cl.[3] ..... F02M 33/02

[52] U.S. Cl. ..... 123/520; 55/163; 55/385 R

[58] Field of Search .....123/518-521, DIG. 2: 220/85 VR, 85 VS; 55/163, 385 R, 387

[56] References Cited

U.S. PATENT DOCUMENTS

| | | | |
|---|---|---|---|
| 3,628,517 | 12/1971 | Soberski | 123/520 |
| 3,752,134 | 8/1973 | Hollis Jr. | 123/520 |
| 4,040,404 | 8/1977 | Tagawa | 123/519 |
| 4,044,743 | 8/1977 | Eaton | 123/520 |
| 4,059,081 | 11/1977 | Kayanuma | 123/521 |
| 4,083,344 | 4/1978 | Sakurai et al. | 123/520 |
| 4,112,898 | 9/1978 | Takimoto et al. | 123/521 |
| 4,116,184 | 9/1978 | Tomita | 123/519 |
| 4,127,097 | 11/1978 | Takimoto | 123/520 |
| 4,133,328 | 1/1979 | King | 123/521 |
| 4,153,025 | 5/1979 | Thornburgh | 123/520 |
| 4,176,639 | 12/1979 | Shinoda et al. | 123/520 |
| 4,193,383 | 3/1980 | Rogers | 123/520 |

FOREIGN PATENT DOCUMENTS

| | | | |
|---|---|---|---|
| 2612300 | 10/1976 | Fed. Rep. of Germany | 123/520 |
| 53-27720 | 3/1978 | Japan | 123/520 |
| 1265060 | 3/1972 | United Kingdom | 123/520 |
| 1273712 | 5/1972 | United Kingdom | 123/518 |
| 1312093 | 4/1973 | United Kingdom | 123/518 |
| 1530511 | 11/1978 | United Kingdom | 123/520 |

*Primary Examiner*—Ira S. Lazarus
*Assistant Examiner*—Magdalen Moy
*Attorney, Agent, or Firm*—James C. Wray

[57] ABSTRACT

A vapor fuel purge system for an automotive vehicle, comprises a fuel source, a cannister containing material for absorbing fuel vapors evaporated from said fuel source, a purge control valve for purging said cannister during normal operation of the vehicle, means for detecting the amount of fuel vapor evaporated from said fuel source, and means for the fuel vapors from being purged from said cannister when said detecting means detects that the amount of the vapor fuel is smaller than a predetermined level.

9 Claims, 9 Drawing Figures

VAPOR FUEL PURGE SYSTEM FOR AN AUTOMOTIVE VEHICLE

BACKGROUND OF THE INVENTION

This invention relates to a vapor fuel purge system for an internal combustion engine.

Existing vehicle emission regulations require that evaporative emissions from the vehicle fuel tank be substantially reduced from current levels. In order to accomplish this reduction in emissions, a cannister is installed on the vehicle and is filled with a desiccant material to absorb vapors which may accumulate in the vehicle fuel tank. However, to minimize the cost of the cannister and the space required for it, a purge control valve is necessary.

For example, in a prior art vapor fuel purge system, the vapor fuel evaporated from such sources as the fuel tank or a float chamber of a carburetor is absorbed by the cannister and thereafter sucked into the intake passage leading to the engine through a purge passage, together with the purge air (fresh air). The quantitative control of the vapor fuel is effected by the purge control valve set on the cannister, which is actuated by the intake vacuum level. When the vapor fuel is thus caused to be sucked into the intake passage, the air-fuel ratio of the gaseous mixture to be sucked into the engine is apt to change. The vapor fuel purge, therefore, is stopped by operating the purge control valve, during low-speed operation and idling of the vehicle, because the driving performance and properties of the exhaust gas must be taken into consideration during those periods.

During the normal speed operation, however, if the vapor fuel from the fuel tank or the float chamber of carburetor, etc. is little in volume due to such factors as the atmospheric temperature and ambient temperature around the fuel tank, greater amount of fresh air than the vapor fuel is sucked into the engine to drastically lower the air-fuel ratio. In such an occasion, the driving performance of the vehicle is degraded. Such an incovenience is invited by the prior art mechanism that the purge control valve is opened in response to the intake vacuum level alone, which allows the valve to be opened even if the vapor fuel from the fuel tank to the cannister is little.

SUMMARY OF THE INVENTION

Therefore, it is an object of the present invention to provide a vapor fuel purge control system for an internal combustion engine in which the foregoing defects of the prior art can be overcome.

It is a further object of the present invention to provide a vapor fuel purge system for an internal combustion engine in which the vapors can be purged from a cannister when the amount of the vapors is more than a predetermined level.

According to the present invention, a vapor fuel purge system for an internal combustion engine includes means for detecting the amount of the fuel vapors vaporized from a fuel source, and means for preventing the fuel vapors from being purged from a cannister to an intake passage through a purge control valve, when the detecting means detects that the amount of the vapors is smaller than a predetermined level. It is preferable that the means for preventing the fuel vapors from being purged from the cannister is an electromagnetic valve provided at an intermediate portion of a path leading to the intake vacuum downstream of a throttle valve or a path leading to the vacuum near the throttle valve. For example, the amount of the vapors is detected indirectly on the basis of the temperature of the fuel in the fuel source or the pressure of the fuel vapors.

BRIEF DESCRIPTION OF THE DRAWINGS

These and other objects, features and advantages of the present invention will become more apparent from the following description of the preferred embodiments thereof when read in conjunction with the accompanying drawings in which.

DETAILED DESCRIPTION OF THE PREFERRED EMBODIMENTS

Figure 1:
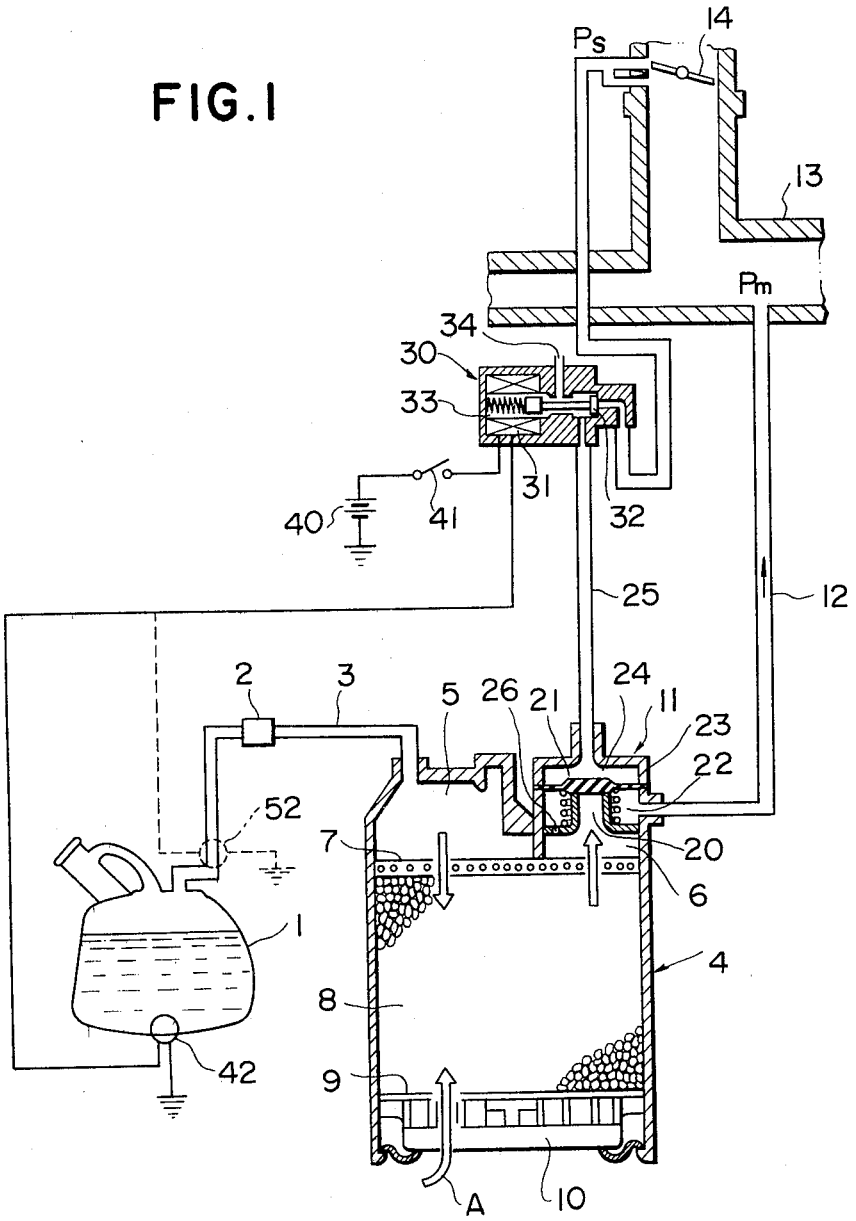
FIG. 1 is a schematic sectional view showing a first embodiment of a vapor fuel purge system for an internal combustion engine according to the present invention.

Referring to FIG. 1, the fuel tank 1 is shown as a typical evaporation source, the upper space thereof being connected with one end of the intake path 3 provided with a check valve 2. The other end of said intake path 3 communicates to the upper first space 5 in the cannister 4. In said cannister 4, the upper first space 5 and the upper second space 6 as partitioned from each other both communicate to the storage space 8 filled with a desiccant material, typically, for example, activated carbon, through a screen 7. The bottom portion of the storage space 8 is open to the atmospheric air through a screen 9 and a filter 10, serving as an entrance for the purge air A. The upper second space 6 is also connected with one end of the purge path 12 through the purge control valve 11. The other end of the purge path 12 is connected with the intake passage 13 leading to the engine, at the downstream of the throttle valve 14.

The vapor fuel in the fuel tank 1 is thus sucked into the upper first space 5 of the cannister 4 through the check valve 2 and intake path 3, and wherefrom into the storage space 8, and adsorbed onto the adsorbent therein.

Figure 2:
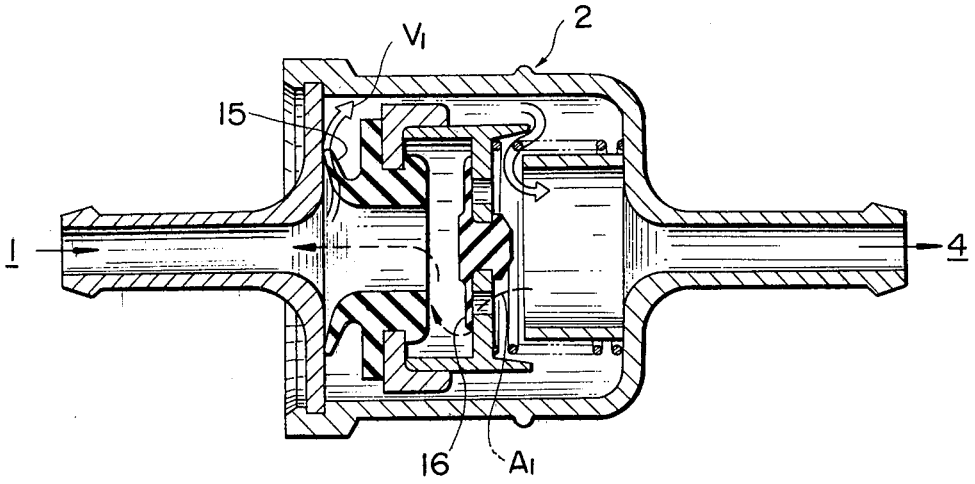
FIG. 2 is a sectional view of the check valve as shown in FIG. 1.

As illustrated in FIG. 2, the check valve 2 has such a construction as follows: when the amount of vapor fuel in the fuel tank 1 is large, i.e., when the inside pressure of the tank 1 is high, the valve 15 opens to let flow the vapor fuel to the cannister 4 as indicated by the arrow $V_1$; and when the inside pressure is low, the valve 16 opens to let flow the air to the fuel tank 1, as indicated by the arrow $A_1$.

Whereas, the manifold vacuum $P_m$ downstream of the throttle valve 14 is introduced via the purge path 12 into the upper second space 6 in the cannister 4 through the purge control valve 11, and the vapor fuel adsorbed by the adsorbent in the storage space 8 is sucked into the intake passage 13 together with the air A fed from the bottom of the cannister 4 and purged. The vapor fuel in the fuel tank 1 is sucked into the storage space 8 of the cannister 4 as aforesaid, and subsequently sucked into the intake passage 13 in the similar manner to be purged.

Figure 3:
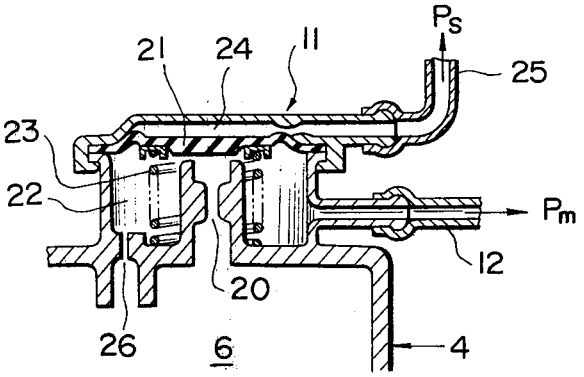
FIG. 3 is a sectional view of the purge control valve as shown in FIG. 1.

FIG. 3 shows the details of the purge control valve 11. A valve diaphragm 21 which freely opens and closes a hole 20 on the wall above the upper second space 6 is provided. The purge path 12 is communicated to the chamber 22 which is formed below the valve diaphragm 21 and on the top wall of space 6. Consequently, the manifold vacuum $P_m$ acts to close the valve diaphragm 21. Also, in said chamber 22, a compressed spring 23 is provided, which works to open the valve diaphragm 21. Furthermore, a throttle vacuum $P_S$ is introduced from near the throttle valve 14 of the intake passage 13 into the chamber 24 formed above the valve diaphragm 21, through the intake vacuum path 25, said vacuum working to open the valve diaphragm 21. The upper second space 6 and the chamber 22 are always communicated through an orifice 26 of a small diameter.

Accordingly, if the difference ($P_m$–$P_S$) between the manifold vacuum $P_m$ and throttle vacuum $P_S$ is little, and the force acting on the valve diaphragm 21 due to the pressure difference is less than the force of the spring 23, the valve diaphragm 21 opens to allow aforesaid sucking action to purge the vapor fuel to the intake passage 13. Conversely, when the pressure difference is large, the valve diaphragm 21 closes. Because the sucking action is then effected through the orifice 26 alone, the purging amount decreases. The so far described mechanisms are similar to those of the conventional device.

Figure 1A:
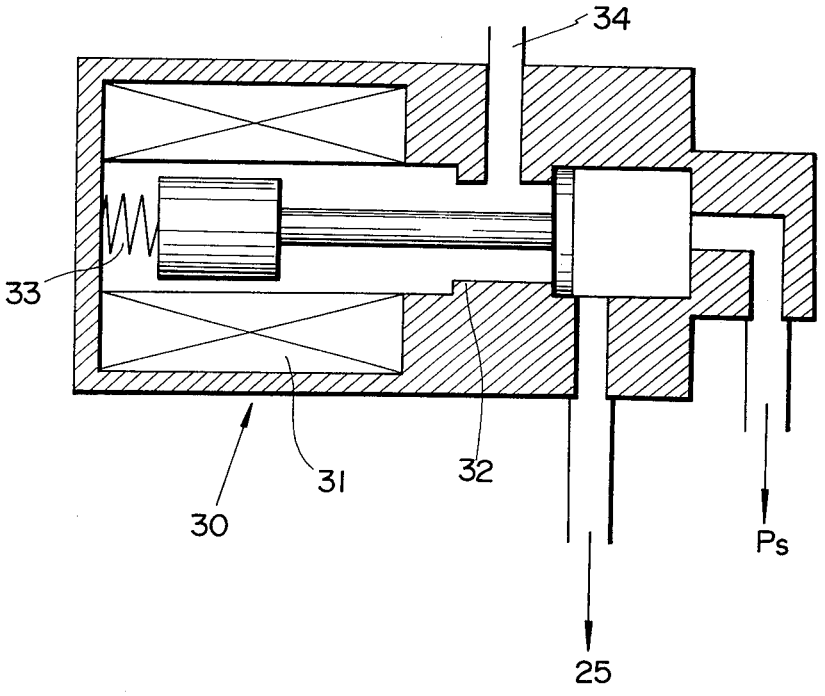
FIG. 1A is a sectional view of the electromagnetic valve used in the vapor fuel system as shown in FIG. 1, showing the condition in which the valve is electrically charged.

According to a preferred embodiment of the present invention, an electromagnetic valve 30 is provided in an intermediate portion of the intake vacuum path 25 of the purge control valve 11. The valve 30 is so designed that, during the normal operation (when the solenoid coil 31 is not electrically charged), the valve 32 is moved to the right in FIG. 1, by the spring 33 to block the intake vacuum path 25 as well as to communicate the purge control valve side of said path 25 to the path 34 opening to the atmosphere. Whereas, when the solenoid coil 31 is electrically charged, the valve 32 is moved to the left, to close the path 34 and open the intake vacuum path 25, as shown in FIG. 1A.

The electric circuit for the electromagnetic valve 30 is provided by connecting to the solenoid coil 31, a battery 40, ignition switch 41 and a temperature-sensitive switch 42 which will be described later, all in series. The temperature-sensitive switch 42 is turned on when the fuel temperature in the fuel tank becomes above a predetermined level.

Figure 4:
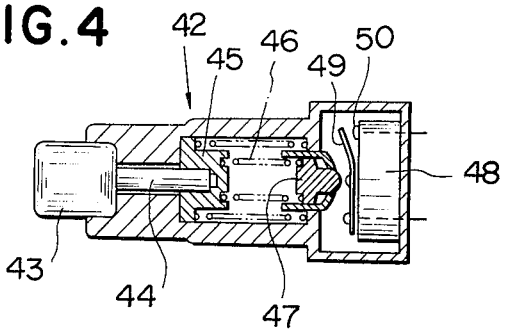
FIG. 4 is a sectional view of the temperature-sensitive switch as shown in FIG. 1.

FIG. 4 shows the details of the switch 42. The temperature-sensitive portion 43 containing a thermowax is placed in the fuel tank 1. When the fuel temperature rises above the predetermined level, a piston 44 is protruded from the temperature-sensitive portion 43, which causes the plunger 47 to contact the movable piece 49 in the switch body 48 with the fixed point of contact 50, through the plate 45 and spring 46. Whereupon the switch 42 is turned "ON".

Therefore, when the amount of vapor fuel in the fuel tank is little, i.e., fuel temperature is low, the temperature-sensitive switch 42 is at "OFF", and the solenoid coil 31 in the electromagnetic valve 30 is not electrically charged. The intake vacuum path 25 to the purge control valve 11 is closed, and the chamber 24 is open to the atmosphere. Obviously the valve diaphragm 21 remains closed, so that the vapor fuel is purged through the orifice 26 alone. Thus the purge amount is restricted to prevent the purge air from being sucked into the intake path 13 in large quantities.

When the fuel temperature is high, on the contrary, the temperature-sensitive switch 42 is turned "ON", to electrically charge the solenoid coil 31 in the electromagnetic valve 30 and open the intake vacuum path 25 to the purge control valve 11. Consequently the valve 11 operates in the conventional manner to control the purge amount.

Figure 5:
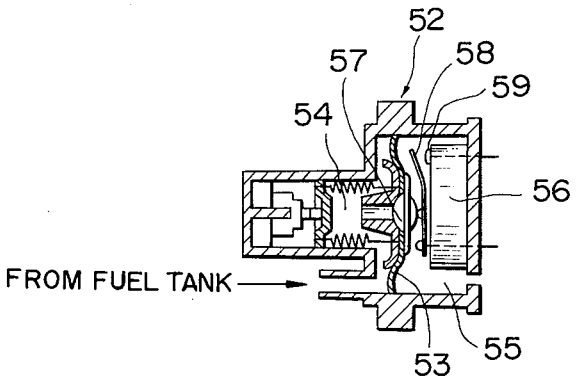
FIG. 5 is a sectional view of the pressure-sensitive switch as shown in FIG. 1.

As the means for detecting the reduced amount of the vapor fuel in the fuel tank 1, a pressure-sensitive switch 52 for detecting the inside pressure of the tank 1 may replace the temperature-sensitive switch 42. FIG. 5 shows an example of such a pressure-sensitive switch 52. On one side of the diaphragm 53, a pressure chamber 54 is provided, the vapor fuel pressure being introduced thereinto from the upper space of the fuel tank 1, and an atmospheric air chamber 55 is formed on the opposite side of the diaphragm 53. The body of the switch 56 is placed in the air chamber 55. When the vapor pressure rises above the predetermined level, the diaphragm 53 is displaced toward the air chamber 55, and the bush 57 fixed thereon causes the movable piece 58 in the switch 56 to contact with the fixed point of contact 59 to turn on the switch 52.

The temperature-sensitive switch 42 and pressure-sensitive switch 52 may be used concurrently, i.e., the both may be inserted into the electromagnetic valve actuating circuit in parallel. By so doing the reduction in the amount of vapor fuel in the fuel tank 1 can be more accurately detected.

Figure 6:
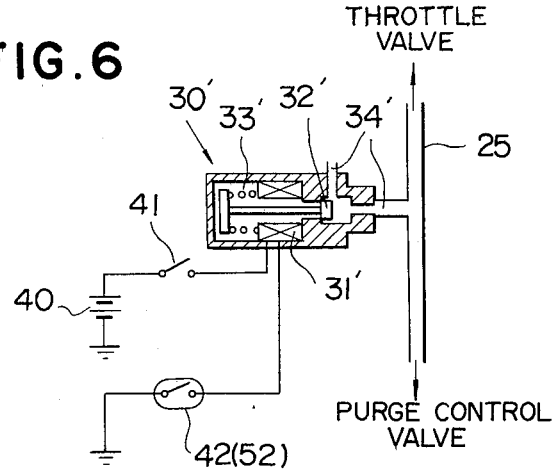
FIG. 6 is a schematic sectional view showing a modification of the electromagnetic valve used in the vapor fuel purge system according to the present invention.

FIG. 6 shows a modification of the electromagnetic valve 30. The electromagnetic valve 30' is attached to the air-communicating path 34' branched from the intake vacuum path 25 in the halfway, said path 34' being opened or closed by a valve 32'. When the solenoid coil 31' is not electrically charged, the valve 32' is pushed leftward by the spring 33' as shown in FIG. 6, to open the air-communicating path 34', introducing the atmospheric air into the intake vacuum path 25 to dilute the vacuum therewith. Thus the valve diaphragm 21 of the purge control valve 11 is kept closed. When the solenoid coil 31' is electrically charged, the valve 32' is moved rightward to close the air-communicating path 34', operating the purge control valve 11 in the normal manner through the intake vacuum path 25.

Figure 7:
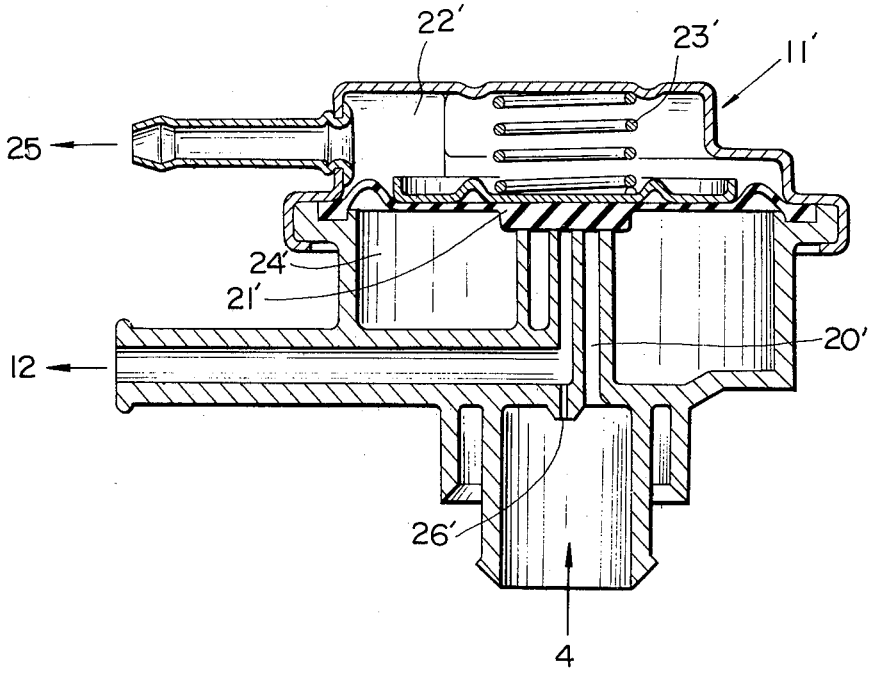
FIG. 7 is a sectional view showing a modification of the purge control valve.

FIG. 7 shows a modification of the purge control valve 11, in which the equivalent parts to those in the foregoing embodiments are given the same reference numerals with an apostrophe. In this embodiment, when the vacuum introduced from the path 25 into the chamber 22' increases, the valve diaphragm 21' is displaced upward against the force of the spring 23' to open the valve to secure the communication between the cannister 4 and the purge path 12.

Figure 8:
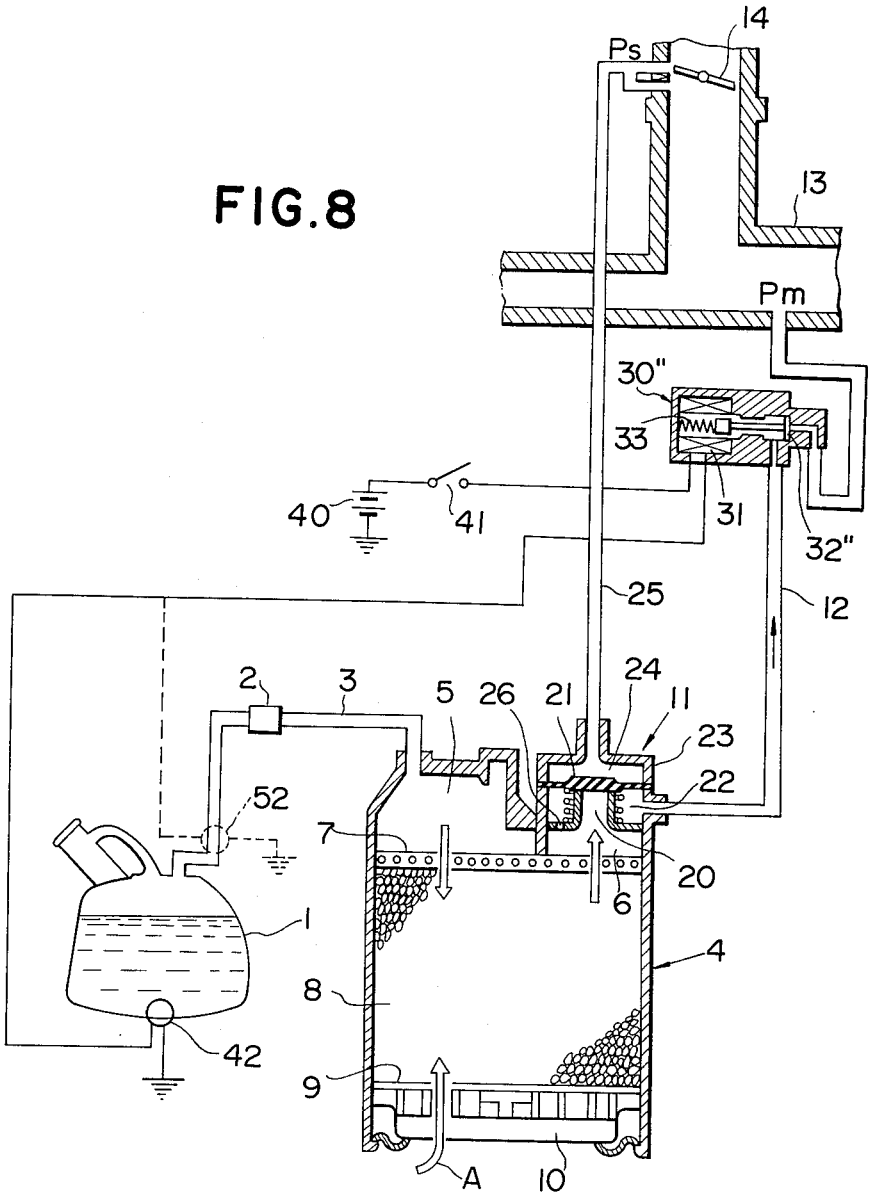
FIG. 8 is a schematic sectional view showing a second embodiment of a vapor fuel purge system according to the present invention.

FIG. 8 shows another embodiment of the present invention. The electromagnetic valve 30'' is provided in an intermediate portion of the path 12 leading to the downstream of the throttle valve 14, in place of the path 25 leading to the vacuum near the throttle valve 14. When the amount of the vapors is less than a predetermined level, the electromagnetic valve 30'' is actuated to close the path 12 so that the vapors cannot be purged from the cannister 4. It is preferable that the valve body 32'' as shown in FIG. 8 includes an orifice of a small diameter although not shown. The same reference numerals denote the same or similar members as shown in FIG. 1, respectively.

As has been so far described, according to the present invention the purging is effected only when the fuel is reasonably vaporized. Consequently, when the amount of vapor fuel is little, reduction of air-fuel ratio by the purge air can be prevented, and the optimum gaseous mixture ratio is maintained to avoid the deterioration in driving performance. The invention thus enables an enlargement in purge area, or purging amount per unit time, over those in the conventional practice.

We claim:

1. A vapor fuel purge system for an internal combustion engine in which a throttle valve controls by its rotation the amount of the air-fuel mixture to be sucked through an intake passage to the engine, comprising:

a fuel source;

a cannister containing material for absorbing fuel vapors evaporated from said fuel source, said cannister having a first upper space and second upper space therein partitioned to each other;

a first path connecting said fuel source with said first upper space of said cannister;

a check valve provided in an intermediate portion of said first path;

a second path leading to the intake vacuum downstream of the throttle valve;

a third path leading to the vacuum near the throttle valve;

a purge control valve provided on said cannister and actuated by the vacuum near the throttle valve introduced through said third path for controlling the communication between said second upper space of said cannister and said second path;

means for detecting the amount of the fuel vapor evaporated from said fuel source; and means for preventing the fuel vapors from being purged from said cannister to the intake passage through said purge control valve and said second path, when said detecting means detects that the amount of the fuel vapors is smaller than a predetermined level.

2. A vapor fuel purge system as defined in claim 1 wherein said means for preventing the fuel vapors from being purged from said cannister is an electromagnetic valve provided at an intermediate portion of said third path.

3. A vapor fuel purge system as defined in claim 1 wherein said means for preventing the fuel vapors from being purged from said cannister in an electromagnetic valve provided at an intermediate portion of said second path.

4. A vapor fuel purge system as defined in claim 1 wherein said detecting means is a pressure-sensitive switch for detecting the pressure of the fuel vapors evaporated from said fuel source.

5. A vapor fuel purge system as defined in claim 1 wherein said detecting means is a temperature-sensitive switch for detecting the temperature of the fuel in said fuel source.

6. A vapor fuel purge system as defined in claim 2 wherein said electromagnetic valve is so designed as to close or open said third path according to the signals from said detecting means.

7. A vapor fuel purge system as defined in claim 2 wherein said electromagnetic valve is so designed as to introduce the atmospheric air into said third path according to the signals from said detecting means when the vapor fuel is prevented from being purged from said cannister.

8. A vapor fuel purge system for an automotive vehicle, comprising:

a fuel source;

a cannister containing material for absorbing fuel vapors evaporated from said fuel source;

a purge control valve for purging said cannister during normal operation of the vehicle;

means for detecting the amount of fuel vapor evaporated from said fuel source; and means for preventing the fuel vapors being purged from said cannister when said detecting means detects that the amount of the vapor fuel is smaller than a predetermined level.

9. A vapor fuel purge system for an automotive vehicle in which a throttle valve controls by its rotation the amount of air-fuel mixture to be sucked through an intake passage to an internal combustion engine, including a cannister installed on said vehicle and filled with material for absorbing fuel vapors vaporated from a fuel source, a purge control valve for controlling communication between said cannister and the intake passage in response to the vacuum near the throttle valve;

means for detecting the amount of the fuel vapor vaporated from said fuel source; and means for preventing the fuel vapors from being purged from said cannister to the intake passage through said purge control valve when said detecting means detects that the amount of the fuel vapors is smaller than a predetermined level.

* * * * *